US011064728B2

(12) United States Patent
Brandao et al.

(10) Patent No.: US 11,064,728 B2
(45) Date of Patent: Jul. 20, 2021

(54) AEROSOL GENERATING ARTICLE HAVING MODIFIED TIPPING WRAPPER AND REMOVABLE TIPPING WRAPPER PORTION

(71) Applicant: PHILIP MORRIS PRODUCTS S.A., Neuchatel (CH)

(72) Inventors: Diogo Meira Brandao, Neuchatel (CH); Nicolas Bueche, Le Paquier (CH); Alen Kadiric, Orpund (CH); Tancredi Merenda, Saint-Blaise (CH)

(73) Assignee: Philip Morris Products S.A., Neuchatel (CH)

( * ) Notice: Subject to any disclaimer, the term of this patent is extended or adjusted under 35 U.S.C. 154(b) by 291 days.

(21) Appl. No.: 16/334,402

(22) PCT Filed: Sep. 25, 2017

(86) PCT No.: PCT/EP2017/074248
§ 371 (c)(1),
(2) Date: Mar. 19, 2019

(87) PCT Pub. No.: WO2018/060141
PCT Pub. Date: Apr. 5, 2018

(65) Prior Publication Data

US 2020/0236990 A1 Jul. 30, 2020

(30) Foreign Application Priority Data

Sep. 29, 2016 (EP) ..... 16191546

(51) Int. Cl.
*A24D 1/02* (2006.01)
*A24D 1/00* (2020.01)

(52) U.S. Cl.
CPC ..... *A24D 1/00* (2013.01); *A24D 1/025* (2013.01)

(58) Field of Classification Search
None
See application file for complete search history.

(56) References Cited

U.S. PATENT DOCUMENTS 4,727,892 A 3/1988 Abdelgawad
2007/0095357 A1 5/2007 Besso
(Continued)

FOREIGN PATENT DOCUMENTS

CN 102227174 10/2011
CN 203446522 2/2014
(Continued)

OTHER PUBLICATIONS

Office Action issued in Russia for Application No. 2019112476 dated Nov. 26, 2020 (19 pages). English translation included.
(Continued)

*Primary Examiner* — Dennis R Cordray
(74) *Attorney, Agent, or Firm* — Mueting Raasch Group

(57) ABSTRACT

An aerosol generating article (10) comprises: an aerosol generating substrate (12); a mouthpiece (14); and a tipping wrapper (20) comprising: a first weakening line (22) extending around at least a portion of the tipping wrapper (20); a removable tipping wrapper portion (26) extending downstream from the first weakening line (22); an upstream tipping wrapper portion (24) extending upstream from the first weakening line (22); a first longitudinal edge (30) extending along the outer surface of the aerosol generating article; and a second longitudinal edge (32) opposed to the first longitudinal edge (30) and overlying the mouthpiece (14). The tipping wrapper (20) overlaps itself in an overlapping region (28) extending at least 45 degrees circumferentially around the aerosol generating article (10). The removable tipping wrapper portion (26) is adhered to itself by means of an area of adhesive (50) provided in the overlapping region (28) and positioned such that the remov-
(Continued)

able tipping wrapper portion (26) comprises an adhesive free area (52) adjacent at least a portion of the first longitudinal edge (30).

15 Claims, 2 Drawing Sheets

(56) References Cited

U.S. PATENT DOCUMENTS

| | | | |
|---|---|---|---|
| 2008/0029111 | A1 | 2/2008 | Dube |
| 2010/0108081 | A1 | 5/2010 | Blevins |
| 2011/0232663 | A1 | 9/2011 | Kadiric |

FOREIGN PATENT DOCUMENTS

| | | |
|---|---|---|
| CN | 203492775 | 3/2014 |
| CN | 105768214 | 7/2016 |
| CN | 205492618 | 8/2016 |
| EP | 0228211 | 7/1987 |
| EP | 1942753 | 5/2009 |
| EP | 2888955 | 7/2015 |
| GB | 2490650 | 11/2012 |
| RU | 2012145671 | 5/2014 |
| RU | 2013144755 | 4/2015 |
| WO | 2010/051076 | 5/2010 |
| WO | WO 2012/120001 | 9/2012 |
| WO | WO 2014/086999 | 6/2014 |
| WO | WO 2016/156209 | 10/2016 |
| WO | WO 2016/188649 | 12/2016 |
| WO | WO 2017/162838 | 9/2017 |

OTHER PUBLICATIONS

PCT Search Report and Written Opinion for EP2017/074248 dated Dec. 7, 2017 (8 pages).

European Extended Search Report for Application No. 16191546.7 dated Mar. 24, 2017 (5 pages).

Office Action issued in China for Application No. 201780054856.9 dated Feb. 25, 2021 (22 pages). English translation included.

AEROSOL GENERATING ARTICLE HAVING MODIFIED TIPPING WRAPPER AND REMOVABLE TIPPING WRAPPER PORTION

This application is a U.S. National Stage Application of International Application No. PCT/EP2017/074248 filed Sep. 25, 2017, which was published in English on Apr. 5, 2018, as International Publication No. WO 2018/060141 A1. International Application No. PCT/EP2017/074248 claims priority to European Application No. 16191546.7 filed Sep. 29, 2016.

The present invention relates to a smoking article comprising a modified tipping wrapper with a removable tipping wrapper portion.

Filter cigarettes typically comprise a cylindrical rod of tobacco cut filler surrounded by a paper wrapper and a cylindrical filter axially aligned in an abutting end-to-end relationship with the wrapped tobacco rod. The cylindrical filter typically comprises a filtration material circumscribed by a paper plug wrap. Conventionally, the wrapped tobacco rod and the filter are joined by a band of tipping wrapper that normally circumscribes the entire length of the filter and an adjacent portion of the wrapped tobacco rod. A conventional filter cigarette is typically smoked by lighting the end of the cigarette opposite the mouthpiece so that the tobacco rod burns.

A number of aerosol generating articles in which tobacco is heated rather than combusted have also been proposed in the art. In heated aerosol generating articles, an aerosol is generated by heating a flavour generating substrate, such as tobacco. Known heated aerosol generating articles include, for example, electrically heated aerosol generating articles and aerosol generating articles in which an aerosol is generated by the transfer of heat from a combustible fuel element or heat source to a physically separate aerosol forming material. During smoking, volatile compounds are released from the aerosol forming substrate by heat transfer from the fuel element and entrained in air drawn through the aerosol generating article. As the released compounds cool they condense to form an aerosol that is inhaled by the consumer. Also known are aerosol generating articles in which a nicotine-containing aerosol is generated from a tobacco material, tobacco extract, or other nicotine source, without combustion, and in some cases without heating, for example through a chemical reaction.

It is known to provide an aerosol generating article having a tipping wrapper with at least one removable portion, wherein the removal of the tipping wrapper portion provides an effect on the smoking experience. For example, EP-A-2 046 153 describes a filter cigarette having a removable outer layer of tipping material, wherein the outer layer of tipping material can be removed by the consumer during or after smoking to provide a different sensory experience.

However, it can be difficult for the consumer to effectively separate the removable portion of the tipping wrapper from the remainder of the tipping wrapper in order to remove it from the mouthpiece. It is known to provide one or more perforation lines in the tipping wrapper in order to assist the tearing of the tipping wrapper, but this will only be effective if the consumer is able to conveniently tear along the perforation lines. This may be difficult in view of the small size of the smoking articles and the tight wrapping of the tipping wrapper around the aerosol generating article. In addition, it can be difficult to achieve a uniform seal along the tipping wrapper seam. In many cases, the tipping wrapper will tear along a different line than the perforation line and so the removable tipping wrapper portion does not come away as a whole piece but may instead need to be removed in several pieces.

It is known to provide a tear tab along the longitudinal edge of the tipping wrapper in order to make it easier for the consumer to grasp and pull the removable portion of the tipping wrapper. However, the incorporation of a sufficiently large tear tab has been found to be difficult from a manufacturing point of view, since it has not been found possible to effectively cut the tear tab shape into the longitudinal edge of the tipping wrapper during the existing high speed manufacturing processes. The existing process and apparatus could in theory be modified or redesigned to provide for a larger tear tab, but this would lead to an undesirable increase in the cost and complexity of manufacture.

It would be desirable to provide an aerosol generating article that includes a novel tipping wrapper arrangement to achieve more reliable removal of a portion of the tipping wrapper. It would be particularly desirable to provide such an aerosol generating article that can be readily manufactured using existing high speed techniques and apparatus with minimal modification.

According to the invention there is provided an aerosol generating article comprising: an aerosol generating substrate; a mouthpiece in axial alignment with the aerosol generating substrate; and a tipping wrapper circumscribing the mouthpiece and at least a portion of the aerosol generating substrate. The tipping wrapper comprises: a first weakening line extending around at least a portion of the tipping wrapper; a removable tipping wrapper portion extending downstream from the first weakening line; an upstream tipping wrapper portion extending upstream from the first weakening line, wherein the upstream tipping wrapper portion is attached to a downstream portion of the aerosol generating substrate and an upstream portion of the mouthpiece; a first longitudinal edge extending along the outer surface of the aerosol generating article; and a second longitudinal edge opposed to the first longitudinal edge and overlying the mouthpiece.

The tipping wrapper circumscribes the mouthpiece and at least a portion of the aerosol generating substrate such that the tipping wrapper overlaps itself in an overlapping region extending the full length of the tipping wrapper and between the first longitudinal edge and the second longitudinal edge, wherein the overlapping region extends at least 45 degrees circumferentially around the aerosol generating article. The removable tipping wrapper portion is adhered to itself by means of an area of adhesive provided in the overlapping region and positioned such that the removable tipping wrapper portion comprises an adhesive free area adjacent at least a portion of the first longitudinal edge.

As used herein, the term "aerosol generating substrate" describes a substrate capable of releasing, upon heating (including combustion), volatile compounds, which can form an aerosol. The aerosol generated from aerosol generating substrates may be visible or invisible and may include vapours (for example, fine particles of substances, which are in a gaseous state, that are ordinarily liquid or solid at room temperature) as well as gases and liquid droplets of condensed vapours.

As used herein, the terms "upstream" and "downstream" describe the relative positions of elements, or portions of elements, of the aerosol generating article in relation to the direction in which a consumer draws on the aerosol generating article during use thereof. Aerosol generating articles as described herein comprise a downstream end (that is, the mouth end) and an opposed upstream end. In use, a consumer draws on the downstream end of the aerosol generating article. The downstream end is downstream of the upstream end, which may also be described as the distal end. The mouthpiece is downstream of the aerosol generating substrate.

As used herein, the term "longitudinal" refers to the direction corresponding to the longitudinal axis of the aerosol generating article or mouthpiece. The "first longitudinal edge" of the tipping wrapper refers to the free edge of the tipping wrapper that extends in a longitudinal direction between the ends of the mouthpiece, along the outer surface of the mouthpiece. The "second longitudinal edge" of the tipping wrapper refers to the opposed free edge of the tipping wrapper that extends in a longitudinal direction between the ends of the mouthpiece, along the surface of the mouthpiece. The second longitudinal edge underlies the portion of tipping wrapper proximate the first longitudinal edge.

The tipping wrapper of aerosol generating articles of the present invention corresponds to the outer wrapper of the mouthpiece, which circumscribes the mouthpiece and the downstream end of the aerosol generating substrate. As described above, the tipping wrapper includes an upstream tipping wrapper portion which attaches the downstream end of the aerosol generating substrate to the upstream end of the mouthpiece and which is intended to stay in place on the aerosol generating article after the removal of the removable tipping wrapper portion. The tipping wrapper further includes a downstream, removable tipping wrapper portion. Initially, the upstream tipping wrapper portion and the removable tipping wrapper portion are connected along the first weakening line and the tipping wrapper can be torn by the consumer along the first weakening line in order to remove the removable tipping wrapper portion.

The aerosol generating articles of the present invention therefore provide a removable tipping wrapper portion that can be removed from the mouthpiece by the consumer, prior to smoking or during smoking, by breaking along the first weakening line in the tipping wrapper. The removal of at least a portion of the tipping wrapper of an aerosol generating article to expose a clean, underlying mouthpiece wrapper may advantageously improve hygiene levels for the consumer. This may be particularly beneficial, for example, where aerosol generating articles have been transported or stored individually, rather than within a container. Furthermore, a removable tipping wrapper portion may be used to provide the consumer with the ability to change the sensory experience obtained during smoking. For example, the mouthpiece may be provided with a flavourant or other additive that is released upon removal of the removable tipping wrapper portion. In another example, the mouthpiece may be provided with additional ventilation which is uncovered when the removable tipping wrapper portion is removed.

In the aerosol generating articles of the present invention, the tipping wrapper is modified to provide an extended circumferential overlap. The "overlapping region" of the tipping wrapper is the area defined between the first longitudinal edge and the second longitudinal edge, in which a double layer of the tipping wrapper is provided due to the tipping wrapper extending circumferentially more than 360 degrees around the aerosol generating article. The overlapping region extends the full length of the tipping wrapper and is therefore additionally bound by the upstream and downstream edges of the tipping wrapper.

In aerosol generating articles according to the present invention, the overlapping region extends at least 45 degrees around the aerosol generating article in a circumferential direction. This means that for any point along the first longitudinal edge of the tipping wrapper, the corresponding point at the same longitudinal position on the second longitudinal edge will be at least 45 degrees around the aerosol generating article in a circumferential direction. The circumferential separation of the first and second longitudinal edges may be substantially constant along the length of the tipping wrapper. For example, this would be the case where the first and second longitudinal edges are both straight and are parallel to each other in the longitudinal direction. Alternatively, the separation of the first and second longitudinal edges may vary along the length of the tipping wrapper, whilst always remaining above 45 degrees. For example, this may be the case where the first longitudinal edge is provided with a tear tab, as described below. In such embodiments, the separation between the first and second longitudinal edges in a circumferential direction would typically be greater in the region of the tear tab, where the tipping wrapper extends further in a circumferential direction.

Preferably, the overlapping region extends at least 60 degrees circumferentially around the aerosol generating article, more preferably at least 75 degrees.

Preferably, the overlapping region extends no more than 90 degrees circumferentially around the aerosol generating article. Such an upper limit is preferable in order to enable the tipping wrapper to be applied using conventional apparatus and techniques without significant modification that might increase the cost and complexity of manufacture.

Preferably, the first and second longitudinal edges are spaced apart in the circumferential direction by at least 3 mm, more preferably by at least 4 mm, more preferably by at least 5 mm. Alternatively or in addition, the first and second longitudinal edges are preferably spaced apart by no more than 6 mm.

In the aerosol generating articles of the present invention, the majority of the removable tipping wrapping portion is typically free from adhesive so that it can be readily removed by the consumer in a single piece. However, an area of adhesive is provided in the overlapping region of the tipping wrapper to adhere the removable tipping wrapper portion to itself so that it remains in place on the mouthpiece prior to use. The removable tipping wrapper portion therefore remains securely in place on the aerosol generating article until the consumer actively removes it from the mouthpiece. By providing an overlapping region which extends at least 45 degrees circumferentially around the aerosol generating article, the area of the overlapping region is increased and becomes possible to provide an area of adhesive that is spaced apart from the first longitudinal edge in the removable tipping wrapper portion. This provides an adhesive free area adjacent to at least a portion of the first longitudinal edge of the removable tipping wrapper portion. In the adhesive free area, the edge of the tipping wrapper can be readily lifted from the surface of the mouthpiece and grasped by the consumer in order to remove the removable tipping wrapper portion.

The adhesive free area preferably extends along the full length of the first longitudinal edge of the removable tipping wrapper portion. Alternatively, the adhesive free area may only extend along a portion of the first longitudinal edge of the removable tipping wrapper portion whilst in other portions, the area of adhesive extends all of the way to the first longitudinal edge.

With such an arrangement of an adhesive free area along the first longitudinal edge, it is possible to reduce the size of a tear tab provided at the first longitudinal edge, or even to eliminate the tear tab entirely, without adversely affecting the ease with which the removable tipping wrapper portion can be removed by the consumer. By reducing the size of the tear tab, or eliminating it from the tipping wrapper entirely, it is possible to overcome the manufacturing difficulties described above.

The increased circumferential overlap of the tipping wrapper additionally enables the area of adhesive in the overlapping region to be provided such that the risk of the adhesive coinciding with the seam of the tipping wrapper at the second longitudinal edge is reduced. This ensures that the seam does not adversely impact the ability of the tipping wrapper to adhere to itself, so that a more uniform seal can be provided. By providing a more uniform seal, the risk of the tipping wrapper tearing at a position away from the first weakening line is advantageously minimised.

The novel tipping wrapper arrangement of the aerosol generating articles according to the invention can be readily achieved using existing high speed manufacturing apparatus and techniques, which require only minor modification to adjust the position of cutting of the tipping wrapper and positioning of the area of adhesive in the overlapping region.

Preferably, the area of adhesive provided in the overlapping region is separated from the first longitudinal edge of the tipping wrapper by at least about 1 mm along the full length of the area of adhesive. This means that at all points along the first longitudinal edge, the area of adhesive is at least about 1 mm apart from the first longitudinal edge in a circumferential direction. This minimum separation provides an adhesive free area of sufficient size to enable the consumer to put their finger or fingernail underneath the edge of the removable tipping wrapper portion in order to remove it. By separating the area of adhesive from the first longitudinal edge by at least about 1 mm, the area of adhesive is also less visible to the consumer.

Preferably, the area of adhesive provided in the overlapping region of the removable tipping wrapper portion extends no more than 45 degrees circumferentially around the aerosol generating article, more preferably no more than 30 degrees. Alternatively or in addition, the area of adhesive provided in the overlapping region preferably extends at least 20 degrees circumferentially around the aerosol generating article. This provides a balance between the need to secure the removable tipping wrapper portion in place on the surface of the mouthpiece whilst allowing the removable tipping wrapper portion to be removed readily by the consumer.

Preferably, the area of adhesive provided in the overlapping region of the removable tipping wrapper portion is separated from the downstream edge of the tipping wrapper by at least about 1 mm to provide an area adjacent the downstream edge of the tipping wrapper that is free from adhesive. This may be particularly advantageous when the tipping wrappers are produced in pairs from a single sheet, so that there is no adhesive at the line along which the sheet is cut to separate the two tipping wrappers (wherein the line corresponds to the downstream edges of the two tipping wrappers). It further ensures that no adhesive is visible at the mouth end of the mouthpiece.

Preferably, the area of adhesive provided in the overlapping region of the removable tipping wrapper portion is separated from the first weakening line by at least about 0.5 mm. Particularly preferably, the area of adhesive is separated from the first weakening line by between about 0.5 mm and about 1.5 mm. This separation of the area of adhesive from the first weakening line ensures that the adhesive does not adversely affect the tearing of the tipping wrapper along the first weakening line when the removable tipping wrapper portion is removed.

The area of adhesive provided in the overlapping region of the removable tipping wrapper portion may take any suitable shape and size within the limits set out above. In certain preferred embodiments, the area of adhesive is a longitudinal strip of adhesive extending along the removable tipping wrapper portion substantially parallel to the first longitudinal edge.

Preferably, the removable tipping wrapper portion is secured to the underlying mouthpiece by means of a second area of adhesive provided proximate the second longitudinal edge. Typically, the second area of adhesive will adhere the removable tipping wrapper portion to the plug wrap of the underlying mouthpiece segment.

Preferably, the second area of adhesive securing the removable tipping wrapper portion to the underlying mouthpiece is separated from the second longitudinal edge by a distance of between about 0.5 mm and about 1 mm. The second area of adhesive is therefore sufficiently close to the second longitudinal edge to enable the leading edge of the tipping wrapper to become adhered to the surface of the mouthpiece as the tipping wrapper is wrapped around the mouthpiece during production. The leading edge of the tipping wrapper is the longitudinal edge that comes into contact with the mouthpiece first as the tipping is wrapped around the mouthpiece during production and in the aerosol generating articles of the present invention corresponds to the second longitudinal edge.

Preferably, the second area of adhesive has a total surface area of between about 4 square millimetres and about 6 square millimetres. This provides a surface area that is large enough to ensure that the tipping wrapper remains secured to the mouthpiece during production but small enough that the removable tipping wrapper portion can be removed from the mouthpiece without tearing the underlying mouthpiece wrapper.

The second area of adhesive may be any suitable size or shape within the limits set out above. Preferably, the second area of adhesive is in the form of a small discrete area of adhesive, such as a dot of adhesive, which is provided at a position along the second longitudinal edge.

Preferably, the second area of adhesive is separated from the downstream edge of the tipping wrapper by at least about 1 mm. This is for similar reasons to those set out above in relation to the preferred separation of the area of adhesive in the overlapping region and the downstream edge.

In certain embodiments of the present invention, the first longitudinal edge of the tipping wrapper may be substantially straight. However, in alternative embodiments of the present invention, the first longitudinal edge of the tipping wrapper comprises a tipping wrapper projection defining a tear tab downstream of the first weakening line, wherein the tear tab is free from adhesive. The tear tab therefore forms a part of the adhesive free area between the first longitudinal edge and the area of adhesive in the overlapping region of the removable tipping wrapper portion.

As used herein, the term "tipping wrapper projection" refers to the portion of the first longitudinal edge which projects away from the remaining portion of portions of the edge in the circumferential direction to define a tear tab at the edge of the tipping wrapper. The tear tab is provided in the removable tipping wrapper portion, downstream of the first weakening line and may facilitate the grasping of the edge of the tipping wrapper by the consumer. The tear tab also provides a visual indication to the consumer of the position of the removable tipping wrapper portion and where the edge of the tipping wrapper should be grasped.

Preferably, a first straight line portion is provided in the first longitudinal edge, extending upstream from the tipping wrapper projection. The "first straight line portion" of the first longitudinal edge of the tipping wrapper extends in a straight line without curvature, substantially parallel to the longitudinal axis of the aerosol generating article.

Preferably, the tipping wrapper projection extends between about 2 mm and about 3 mm beyond the first straight line portion in the circumferential direction, more preferably between about 2 mm and about 2.5 mm. This corresponds to the circumferential distance between the first straight line portion and the "top" of the tipping wrapper projection where the height is greatest, which defines the height of the tear tab relative to the straight part of the longitudinal edge.

By providing a tear tab with a height of at least 2 mm, the tear tab is of a convenient size for the consumer to grasp. On the other hand, keeping the height of the tear tab less than or equal to 3 mm is typically preferred from a manufacturing point of view as it is more difficult to cut larger tear tabs at high speed using conventional cutting knives. In the aerosol generating articles according to the invention, the tear tab is provided in addition to the adhesive free area along the full length of the first longitudinal edge of the removable tipping wrapper portion. Therefore it is possible to provide a tear tab having a smaller height than would be desirable for aerosol generating articles in which the tear tab is the only adhesive free portion, whilst still enabling the consumer to easily grasp the edge. The smaller tear tab can be more easily incorporated into the edge of the tipping wrapper using existing cutting apparatus and techniques.

Preferably, the width of the tipping wrapper projection in the longitudinal direction is at least about 2.5 mm. Alternatively or in addition, the width of the tipping wrapper projection in the longitudinal direction is less than 15 mm. The "width" of the tipping wrapper projection corresponds to the maximum dimension of the tipping wrapper projection in the longitudinal direction.

The position of the tipping wrapper projection relative to the first weakening line may be varied, for example, in order to minimise the risk of tearing of the tipping wrapper other than along the first weakening line. Preferably, the tipping wrapper projection is provided between about 0 mm and about 15 mm downstream of the first weakening line, more preferably between about 5 mm and about 10 mm. This corresponds to the distance between the first weakening line and the upstream end of the tipping wrapper projection.

As described above, the first longitudinal edge preferably comprises a first straight line portion extending upstream from the tipping wrapper projection. Preferably, in such embodiments, the tipping wrapper projection comprises a first curved transition portion connecting the first straight line portion of the first longitudinal edge to the remainder of the tipping wrapper projection, wherein the first curved transition portion of the tipping wrapper projection follows a convex curve.

As used herein, the term "first curved transition portion" refers to the portion of the tipping wrapper projection connecting the first straight line portion to the remainder of the tipping wrapper projection. The upstream end of the first curved transition portion corresponds to the point at which the longitudinal edge begins to curve away from the first straight line portion, as determined by the naked eye. The downstream end of the first curved transition portion corresponds to the point at which the curvature of the tipping wrapper projection changes direction from the convex curvature of the first curved transition portion, as determined by the naked eye. For example, where the tipping wrapper projection is a continuous curve, the downstream end of the first curved transition portion corresponds to the inflection point at which the curvature of the tipping wrapper projection changes from convex to concave. In other embodiments, the downstream end of the first curved transition portion may correspond to a corner where the convex curvature of the first curved transition portion changes to a linear portion.

The term "convex" is used herein to describe a portion of the tipping wrapper projection curve that has a curve with a gradient that increases as the curve moves away from the tipping wrapper in a circumferential direction. In the case of the first curved transition portion, the gradient therefore increases moving along the curve in the downstream direction. All tangents to the convex curve lie below the curve when the tipping wrapper is viewed in a flat state with the longitudinal edge incorporating the tipping wrapper projection along the top. A "convex" curve may also be described as "concave upward" or "convex downward".

As described above, the first curved transition portion of the tipping wrapper projection "follows a convex curve". This is intended to cover embodiments in which the first curved transition portion is convexly curved as well as embodiments in which the first curved transition portion approximates a convex curve.

The convex curvature of the first curved transition portion of the tipping wrapper projection, as described above, advantageously provides a gradual transition between the first straight line portion and the tipping wrapper projection and ensures that there are no sharp angles or corners in the region of the longitudinal edge where the tear tab meets the first straight line portion. This in turn ensures that there should be no specific points of weakness introduced by the tipping wrapper projection, thereby minimising the risk of tearing the tipping wrapper away from the first line of weakness.

In embodiments according to the present invention in which the tipping wrapper incorporates a tear tab, as described above, the second longitudinal edge of the tipping wrapper may optionally comprise an indent corresponding in shape and position to the tipping wrapper projection on the first longitudinal edge. The provision of an indent at the second longitudinal edge may occur where the tipping wrapper is cut from a continuous sheet of tipping wrapper material, such that the tear tab cut into the first longitudinal edge of a first tipping wrapper will produce a corresponding indent at the second longitudinal edge of the adjacent tipping wrapper cut from the sheet.

The provision of an extended circumferential overlap in the tipping wrapper may be particularly advantageous in such embodiments where an indent is provided at the second longitudinal edge. It has previously been found that where such an indent is present, it can adversely affect the quality of the seal in the overlapping region, since in the region of the indent, the top layer of tipping wrapper may not adhere properly to the mouthpiece due to the missing material in the underlying layer of tipping wrapper. This can cause the tipping wrapper to tear in the wrong position, away from the first line of weakness, when the consumer attempts to remove the removable tipping wrapper portion. In the aerosol generating articles according to the present invention, the extended circumferential overlap in the tipping wrapper provides sufficient space that the area of adhesive in the overlapping region can be positioned away from the indent.

In this way, the indent does not impact the ability of the layers of tipping wrapper to stick to each other.

The tipping wrapper projection may take a variety of suitable shapes. Preferably, the tipping wrapper projection is curved and particularly preferably, the tipping wrapper projection is a continuous, smooth curve. For example, the tipping wrapper projection may follow a bell-shaped curve, preferably a symmetric bell-shaped curve such as a normal or Gaussian-like curve.

In certain preferred embodiments, the first longitudinal edge of the tipping wrapper comprises a second straight line portion extending downstream from the tipping wrapper projection to the downstream end of the removable tipping wrapper portion. The second straight line portion is typically at substantially the same circumferential position as the first straight line portion. In such embodiments, the tear tab defined at the first longitudinal edge of the tipping wrapper is preferably a symmetric curve, as described above.

In alternative embodiments, the tipping wrapper projection may be asymmetric and extend to the downstream edge of the removable tipping wrapper portion. In such embodiments, the tear tab defined at the first longitudinal edge of the tipping wrapper will typically have an elongate shape.

As described above, the tipping wrapper of the aerosol generating articles of the present invention comprises a removable tipping wrapper portion defined downstream of the first weakening line. The upstream tipping wrapper portion, defined upstream of the first weakening line, is attached to a downstream portion of the aerosol generating substrate and an upstream portion of the mouthpiece.

The position of the first weakening line along the mouthpiece may be adjusted depending upon how much of the tipping wrapper is intended to be removed. Preferably, the first weakening line is positioned at least about 5 mm from the upstream end of the mouthpiece, in a longitudinal direction. This ensures that a sufficient portion of the tipping wrapper remains on the aerosol generating article to provide the upstream tipping wrapper portion. Alternatively or in addition, the first weakening line is preferably positioned no more than 15 mm from the upstream end of the mouthpiece.

Preferably, the first weakening line extends around at least 75 percent of the circumference of the mouthpiece, more preferably around at least 85 percent of the circumference. In certain preferred embodiments, the first weakening line extends around substantially the entire circumference of the mouthpiece.

The length of the removable tipping wrapper portion in the longitudinal direction of the aerosol generating article may also be adjusted depending, for example, upon the intended effect of the removal of a portion of the tipping wrapper.

In certain embodiments of the present invention, the removable tipping wrapper portion extends to the downstream end of the mouthpiece so that the entire tipping wrapper downstream of the first weakening line is removed to expose the underlying mouthpiece surface. This arrangement may be advantageous, for example, where the removable tipping wrapper portion is provided for the improvement of hygiene during smoking.

In alternative embodiments of the present invention, the tipping wrapper may further comprise a second weakening line spaced apart from the first weakening line in the downstream direction, wherein the removable tipping wrapper portion is defined between the first weakening line and the second weakening line. In such embodiments, the tipping wrapper preferably further comprises a downstream tipping wrapper portion extending downstream from the second weakening line and attached to a downstream portion of the mouthpiece. This arrangement may be preferable, for example, where a strip of the tipping wrapper is removable in order to expose an underlying additive or ventilation.

The first weakening line and the second weakening line (where present) may take any suitable form to provide a line of weakness in the tipping wrapper along which the tipping wrapper will preferentially tear. Preferably, each weakening line comprises multiple cuts spaced apart in a circumferential direction to form a row of perforations extending around the tipping wrapper. In such embodiments, the row of perforations preferably extends around substantially the entire circumference of the tipping wrapper. To aid the consumer in tearing the tipping wrapper along the row of perforations, the weakening line may comprise an elongate cut extending between an edge of the tipping wrapper at a tipping wrapper seam and the first perforation in the row of perforations.

Where a row perforations is provided, the row of perforations comprises uncut segments of tipping wrapper between consecutive perforations. The total length of the uncut segments preferably defines a percentage of hold of between about 15 percent and about 30 percent of the total length of the row of perforations, more preferably between about 18 percent and about 25 percent.

A "percentage of hold" for a row of perforations can be used as an indication of the strength of the row of perforations and is defined as:

$$\text{percentage of hold} = \frac{\text{total length of uncut segments}}{\text{total length of uncut segments} + \text{total length of perforations}} \times 100$$

wherein the length of each uncut segment is the shortest distance along the tipping wrapper between adjacent perforations, and wherein the length of each perforation is the length of a straight line drawn between the two circumferential extremities of the perforation. In the case of a circular perforation, the length of the perforation is the diameter of the circle.

A high percentage of hold therefore represents a row of perforations in which a large amount of uncut material remains between the perforations. A row of perforations that has a high percentage of hold will generally require more force to break the tipping wrapper along the row of perforations.

Advantageously, a percentage of hold of between 15 percent and 30 percent is large enough to prevent accidental breakage of the tipping wrapper along the row of perforations when the tipping wrapper is handled during manufacture of the smoking article, while remaining low enough so that only a moderate breaking force is required to intentionally break the wrapper along the row of perforations after the smoking article has been constructed. It has been found that the force required to break a wrapper along a row of perforations defining a percentage of hold within this range is largely independent of the basis weight of the sheet material used to form the tipping wrapper when comparing different sheet materials that are typically used to form wrappers for smoking articles.

The row of perforations may optionally be provided with one or more additional features as described in EP-A-2 888 958.

The tipping wrapper is preferably formed of a sheet of paper material, although other materials would also be suitable. Preferably, the tipping wrapper is formed of a sheet material having a basis weight of between about 35 grams per square metre and about 50 grams per square metre.

In aerosol generating articles according to the present invention, the removal of the removable tipping wrapper portion exposes the underlying mouthpiece or mouthpiece segment, which will typically be wrapped in one or more mouthpiece wrappers. In any of the embodiments described above, the mouthpiece may comprise a mouthpiece wrapper circumscribing one or more mouthpiece segments. For example, the mouthpiece may comprise a single segment of filter material and the mouthpiece wrapper may be an individual plug wrap circumscribing the single segment of filter material. Alternatively, the mouthpiece may comprise a plurality of segments of filter material and the mouthpiece wrapper may be a combining plug wrap circumscribing the plurality of segments of filter material. In such embodiments, each of the segments of filter material may be wrapped in an individual plug wrap underlying the combining plug wrap.

The mouthpiece wrapper may be formed from a porous material, such as a porous paper. However, the mouthpiece wrapper is preferably formed from a non-porous material, such as a non-porous paper or a polymeric material. The non-porous material may comprise an inherently non-porous material, or the non-porous material may comprise a porous substrate onto which a non-porous coating is applied. Preferably, the mouthpiece wrapper has a porosity of less than about 20 Coresta Units, more preferably less than about 10 Coresta Units, and more preferably less than about 5 Coresta Units, measured in accordance with the Coresta Recommended Method No. 40. Most preferably, the mouthpiece wrapper has a porosity of about zero Coresta Units. Suitable materials for forming the mouthpiece wrapper include cellulosic polymeric materials, starch-based polymeric materials, polyvinyl alcohol, cellophane, polylactide, and combinations thereof.

A coating may be applied to an outer surface of the mouthpiece wrapper to provide a moisture barrier that may minimise the risk of a consumer's lips or mouth wetting the mouthpiece wrapper and may therefore reduce the risk of a consumer's lips or mouth sticking the mouthpiece wrapper after the removable tipping wrapper portion has been removed. For example, a suitable lip-release lacquer may be applied to an outer surface of the mouthpiece wrapper, as known to the skilled person. The coating may be in addition to, or as an alternative to, a non-porous coating applied to the mouthpiece wrapper, as described above. In those embodiments in which the mouthpiece wrapper comprises a non-porous coating and a lip-release coating, both coatings may comprise the same coating material. Alternatively, the non-porous coating and the lip release coating may comprise different coating materials.

The mouthpiece wrapper may have a basis weight of less than about 90 grams per square metre. The mouthpiece wrapper preferably has a basis weight of more than about 20 grams per square metre.

In certain preferred embodiments, the mouthpiece wrapper comprises a plug wrap or combination of plug wraps having a basis weight of between about 50 grams per square metre and about 115 grams per square metre, more preferably between about 65 grams per square metre and about 85 grams per square metre and most preferably between about 60 grams per square metre and about 70 grams per square metre. By providing a plug wrap or combination of plug wraps having a basis weight within this range, a relatively stiff mouthpiece wrapper is obtained. This advantageously provides a filter that can retain a desirable level of hardness even when the removable tipping wrapper portion has been removed.

In certain embodiments, the plug wrap may extend downstream of the mouthpiece segments to define a mouth end recess. In such embodiments, the use of a plug wrap having a relatively high basis weight as defined above advantageously helps to retain the structure of the recess during smoking. Alternatively or in addition to the provision of a plug wrap extending downstream of the mouthpiece, the mouthpiece may further comprise a hollow tubular segment to define a mouth end recess, for example, a tubular segment of cellulose acetate.

In some embodiments the aerosol generating article further comprises a combining wrapper circumscribing at least a portion of each of the mouthpiece and the aerosol generating substrate to secure the mouthpiece to the aerosol generating substrate. In such embodiments, the upstream tipping wrapper portion may be attached only to a portion of the combining wrapper overlying the mouthpiece. Alternatively, the upstream tipping wrapper portion may be attached only to a portion of the combining wrapper overlying the aerosol generating substrate. In some embodiments, the upstream tipping wrapper portion is attached to a portion of the combining wrapper overlying the mouthpiece and a portion of the combining wrapper overlying the aerosol generating substrate.

Alternatively, the aerosol generating article may not comprise a separate combining wrapper and the tipping wrapper itself may be used to secure the mouthpiece to the aerosol generating substrate. In such embodiments, the aerosol generating article may further comprise an aerosol generating substrate wrapper wrapped around at least a portion of the aerosol generating substrate, wherein the upstream tipping wrapper portion is attached to a downstream portion of the aerosol generating substrate wrapper and an upstream portion of the mouthpiece.

The outer surface of the mouthpiece wrapper may be provided with text or graphics that are revealed to the consumer when the removable tipping wrapper portion is removed by the consumer during use. For example, the outer surface of the mouthpiece wrapper may be printed with inks to provide an aesthetic feature underneath the removable tipping wrapper portion.

In certain embodiments of the invention, at least one flavourant may be provided between the removable tipping wrapper portion and the underlying mouthpiece portion. As used herein, the term "flavourant" is used to describe a material that can be used to deliver at least one of a gustatory sensation and an olfactory sensation to the consumer. By providing a flavourant underneath the removable tipping wrapper portion, a consumer is provided with control over when the flavourant is delivered. Suitable flavourants for incorporation into aerosol generating articles would be known to the skilled person.

The at least one flavourant may be provided on a surface of the removable tipping wrapper portion facing the underlying mouthpiece portion, on the surface of the underlying mouthpiece portion, or both. The at least one flavourant may be deposited as a coating, or may be impregnated into the surface of the removable tipping wrapper portion or mouthpiece portion. The at least one flavourant may be encapsulated, for example, contained within a plurality of microcapsules, to reduce or prevent migration of the flavourant.

Alternatively or in addition to the provision of a flavourant between the removable tipping wrapper portion and the underlying mouthpiece portion, the mouthpiece may comprise at least one surface formation underlying the removable tipping wrapper portion. As used herein, the term "surface formation" describes a variation in a surface of the mouthpiece that results in the surface being non-uniform. By providing at least one surface formation on the surface of the mouthpiece underlying the removable tipping wrapper portion, a consumer is provided with a choice over the surface texture of the aerosol generating article that contacts their lips during smoking or otherwise using the aerosol generating article.

The mouthpiece may comprise a mouthpiece wrapper, as described above, wherein the mouthpiece wrapper comprises the at least one surface formation. The at least one surface formation may comprise at least one of an embossment and a debossment. Alternatively or in addition, the at least one surface formation may comprise a variation in the thickness of the mouthpiece wrapper. Alternatively or in addition, the at least one surface formation may comprise one or more materials deposited or otherwise provided on a surface of the mouthpiece wrapper, for example, at least one of an ink or varnish.

Aerosol generating articles according to the present invention may be filter cigarettes or other smoking articles in which the aerosol generating substrate comprises a tobacco material that is combusted to form smoke. Therefore, in any of the embodiments described above, the aerosol generating substrate may comprise a tobacco rod.

Alternatively, aerosol generating articles according to the present invention may be articles in which a tobacco material is heated to form an aerosol, rather than combusted. In one type of heated aerosol generating article, a tobacco material is heated by one or more electrical heating elements to produce an aerosol. In another type of heated aerosol generating article, an aerosol is produced by the transfer of heat from a combustible or chemical heat source to a physically separate tobacco material, which may be located within, around or downstream of the heat source. The present invention further encompasses aerosol generating articles in which a nicotine-containing aerosol is generated from a tobacco material, tobacco extract, or other nicotine source, without combustion, and in some cases without heating, for example through a chemical reaction.

The invention will now be further described, by way of example only, with reference to the accompanying drawings in which.

Figure 1:
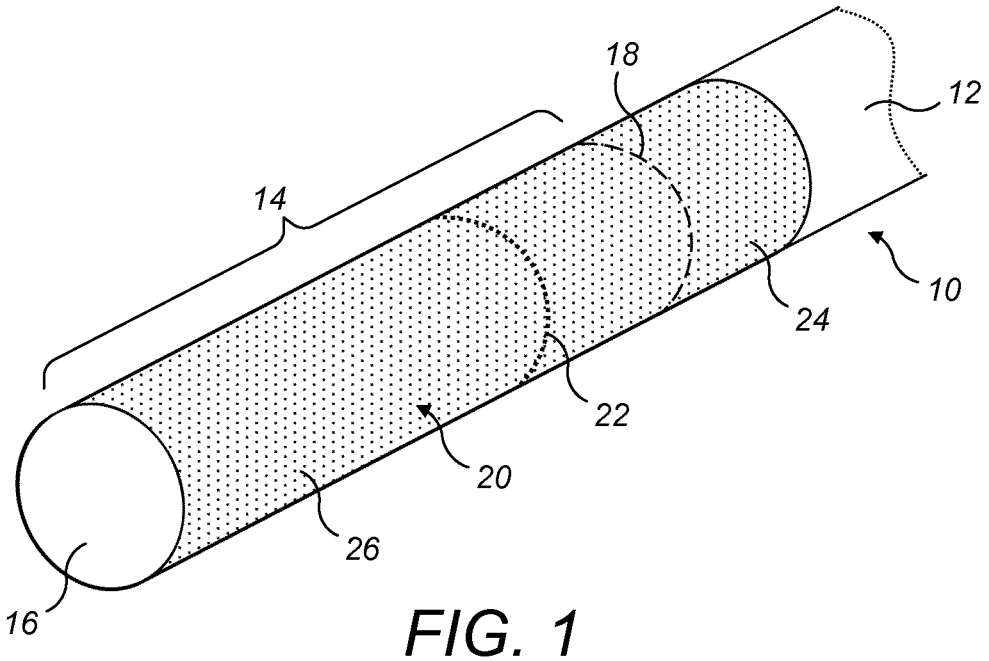
FIG. 1 shows an aerosol generating article in accordance with a first embodiment of the present invention.

FIG. 1 shows an aerosol generating article 10 according to a first embodiment of the present invention. The aerosol generating article 10 is a filter cigarette comprising an aerosol generating substrate 12 in the form of a wrapped tobacco rod and a mouthpiece 14 comprising a single segment of filtration material 16 axially aligned with the tobacco rod. A downstream end of the tobacco rod abuts an upstream end of the mouthpiece 14 along the line 18 shown in FIG. 1.

A tipping wrapper 20 comprising a row of perforations that form a weakening line 22 is wrapped around the mouthpiece 14 and a portion of the tobacco rod so that an upstream tipping wrapper portion 24 extends upstream from the weakening line 22, and a removable tipping wrapper portion 26 extends downstream from the weakening line 22. The upstream tipping wrapper portion 24 is glued to the underlying portions of the tobacco rod and the mouthpiece 14.

The removable tipping wrapper portion 26 is adhered to the surface of the underlying mouthpiece 14 and also to itself, as described in more detail below, in order to secure the removable tipping wrapper portion 26 in place on the mouthpiece.

Figure 2:
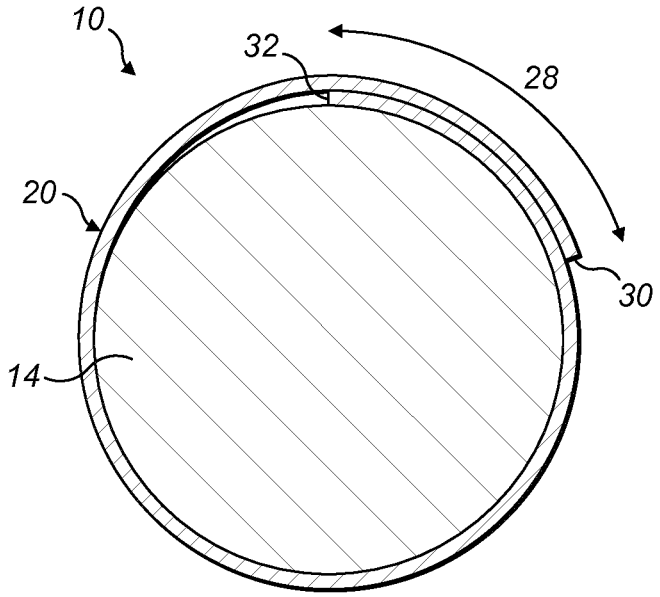
FIG. 2 shows a schematic transverse cross-sectional view of the aerosol generating article of FIG. 1.

As shown in the cross-sectional view of the aerosol generating article 10 in FIG. 2, the tipping wrapper 20 extends approximately 420 degrees circumferentially around the aerosol generating article 10 and therefore overlaps with itself by approximately 60 degrees in an overlapping region 28. In this overlapping region 28 there is therefore a double layer of tipping wrapper 20.

The tipping wrapper 20 comprises a first longitudinal edge 30 which extends longitudinally along the outer surface of the aerosol generating article 10 to form a seam on the outside of the mouthpiece. The tipping wrapper 20 further comprises a second longitudinal edge 32, opposite the first longitudinal edge 30, which runs along the surface of the underlying segment of filtration material 16 and underlies the opposite end of the tipping wrapper 20 proximate the first longitudinal edge 30. The overlapping region 28 extends between the first 30 and second 32 longitudinal edges and is also bound by the upstream edge 34 and the downstream edge 36 of the tipping wrapper 20.

Figure 3:
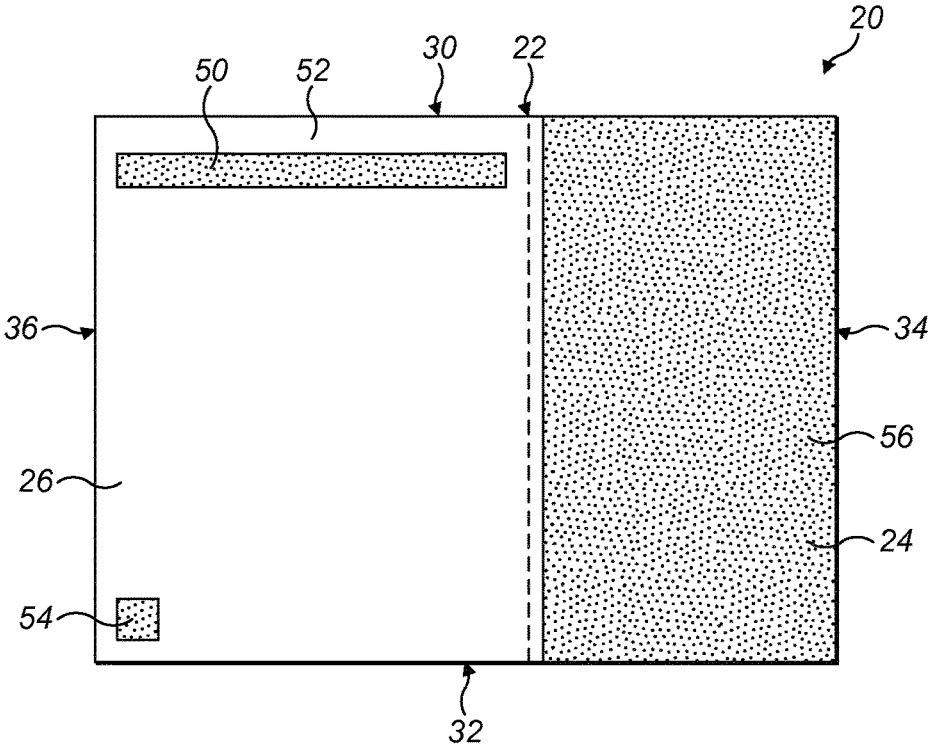
FIG. 3 shows a plan view of the tipping wrapper of the aerosol generating article of FIG. 1.

In the tipping wrapper 20 shown in FIGS. 1 to 3, the first 30 and second 32 longitudinal edges are both straight edges and when the tipping wrapper 20 is in place on the aerosol generating article 10, the longitudinal edges extend substantially parallel to each other and the longitudinal axis of the aerosol generating article 10. The overlapping region 28 therefore extends 60 degrees circumferentially around the aerosol generating article 10 along the full length of the tipping wrapper 20, such that the extent of the overlap of the tipping wrapper 20 is constant along the length of the mouthpiece. In alternative embodiments, the extent to which the tipping wrapper 20 overlaps with itself may differ along the length of the tipping wrapper whilst always remaining above 45 degrees.

FIG. 3 shows a plan view of the tipping wrapper 20 indicating where adhesive is applied to the tipping wrapper 20 in order to secure it in place on the mouthpiece 14. A first area of adhesive 50 is provided in the removable tipping wrapper portion 26, proximate the first longitudinal edge 30. The first area of adhesive 50 is in the form of a narrow, rectangular strip of adhesive which runs substantially parallel to the first longitudinal edge 30 and extends approximately 30 degrees circumferentially around the aerosol generating article when the tipping wrapper 20 is in place. The first area of adhesive 50 is separated from the first longitudinal edge 30 by approximately 1.5 mm and from the downstream edge 36 by approximately 1.5 mm. It is also separated from the weakening line 22 by approximately 1.5 mm.

When the tipping wrapper 20 is in place on the aerosol generating article 10, the first area of adhesive 50 is provided in the overlapping region 28 in order to secure the removable tipping wrapper portion 26 to itself. The area of the tipping wrapper 20 between the first area of adhesive 50 and the first longitudinal edge 30 is free from adhesive and this provides an adhesive free area 52 which extends along the full length of the removable tipping wrapper portion 26.

A second area of adhesive 54 is provided in the removable tipping wrapper portion 26, proximate the second longitudinal edge 32. The second area of adhesive 54 is a small dot of adhesive having a total surface area of approximately 5 square millimeters, which is located adjacent the second longitudinal edge 32. The second area of adhesive 54 is proximate the downstream edge 36 but separated from the downstream edge 36 by approximately 1 mm.

When the tipping wrapper 20 is in place on the aerosol generating article 10, the second area of adhesive 54 is provided between the tipping wrapper 20 and the outer surface of the underlying segment of filtration material 16 in order to secure the removable tipping wrapper portion 26 in place on the mouthpiece 14.

A third area of adhesive 56 is provided over the upstream tipping wrapper portion 24. The third area of adhesive 56 is separated from the weakening line 22 by approximately 1 mm but otherwise covers substantially the entire area of the upstream tipping wrapper portion 24. When the tipping wrapper 20 is in place on the aerosol generating article 10, the third area of adhesive 56 is provided between the upstream tipping wrapper portion 24 and the underlying portions of the mouthpiece 14 and tobacco rod in order to secure the upstream tipping wrapper portion 24 in place.

Before, during or after smoking the aerosol generating article 10, the consumer can remove the removable tipping wrapper portion 26, if desired, to expose the underlying portion of the mouthpiece 14. To remove the removable tipping wrapper portion 26 the consumer can lift the adhesive free area 52 of the tipping wrapper adjacent the first longitudinal edge 30 and peel the removable tipping wrapper portion 26 away from the mouthpiece 14 by breaking the seal provided by the first area of adhesive 50 and tearing along the row of perforations forming the first weakening line 22.

Figure 4:
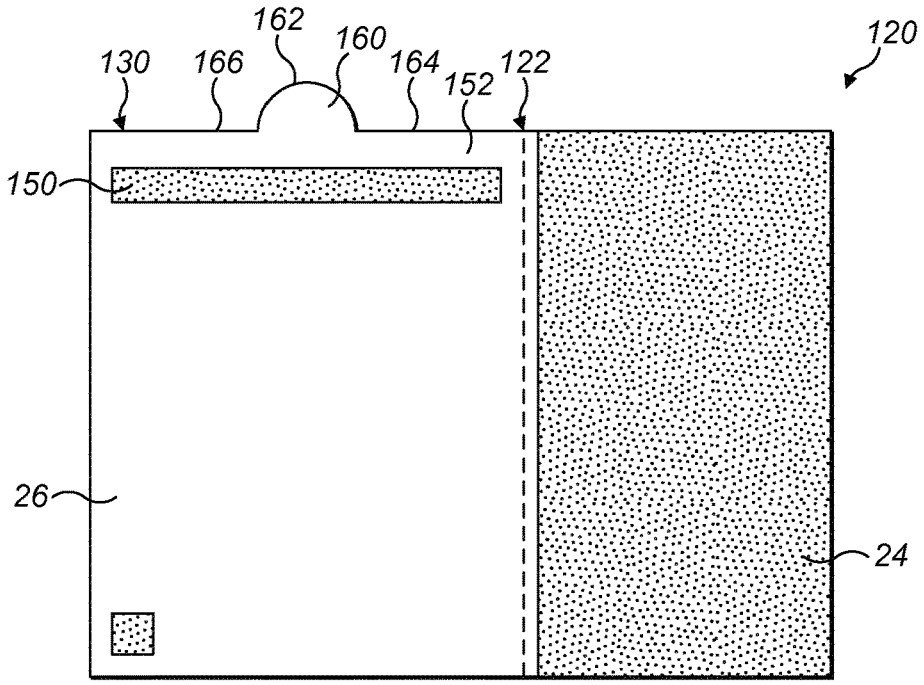
FIG. 4 shows a plan view of an alternative tipping wrapper for the aerosol generating article of FIG. 1.

FIG. 4 shows an alternative tipping wrapper 120 for the aerosol generating article 10 of FIG. 1. The tipping wrapper 120 differs from the tipping wrapper 20 shown in FIG. 3 in that a tear tab 160 is provided at the first longitudinal edge 130. The tear tab 160 forms part of the adhesive free area 152 of the tipping wrapper 120 between the first longitudinal edge 130 and the first area of adhesive 150. The tear tab 160 is defined by a tipping wrapper projection 162 along the first longitudinal edge 130 at a distance downstream of the first weakening line 122. A first straight line portion 164 extends upstream from the tipping wrapper projection 162 to the upstream end of the tipping wrapper 120 and a second straight line portion 166 extends downstream from the tipping wrapper projection 162 to the downstream end of the tipping wrapper 120. In the assembled aerosol generating article 10, the first straight line portion 164 and the second straight line portion 166 are in line with each other, at the same position around the circumference. The tipping wrapper projection 162 is in the form of a symmetric bell-shaped curve.

The provision of the tear tab 160 at the first longitudinal edge 130 may facilitate the lifting and grasping of the edge of the removable tipping wrapper portion 26 by the consumer. The tear tab 160 also provides a visual indication of where the consumer should grasp the tipping wrapper in order to remove the removable tipping wrapper portion 26.

The invention claimed is:

1. An aerosol generating article comprising:

an aerosol generating substrate;

a mouthpiece in axial alignment with the aerosol generating substrate; and a tipping wrapper circumscribing the mouthpiece and at least a portion of the aerosol generating substrate, the tipping wrapper comprising:

a first weakening line extending around at least a portion of the tipping wrapper;

a removable tipping wrapper portion extending downstream from the first weakening line;

an upstream tipping wrapper portion extending upstream from the first weakening line, wherein the upstream tipping wrapper portion is attached to a downstream portion of the aerosol generating substrate and an upstream portion of the mouthpiece;

a first longitudinal edge extending along the outer surface of the aerosol generating article; and a second longitudinal edge opposed to the first longitudinal edge and overlying the mouthpiece, wherein the tipping wrapper circumscribes the mouthpiece and at least a portion of the aerosol generating substrate such that the tipping wrapper overlaps itself in an overlapping region extending the full length of the tipping wrapper and between the first longitudinal edge and the second longitudinal edge, wherein the overlapping region extends at least 45 degrees circumferentially around the aerosol generating article; and wherein the removable tipping wrapper portion is adhered to itself by means of an area of adhesive provided in the overlapping region and positioned such that the removable tipping wrapper portion comprises an adhesive free area adjacent at least a portion of the first longitudinal edge.

2. An aerosol generating article according to claim 1 wherein the overlapping region extends at least 60 degrees circumferentially around the aerosol generating article between the first longitudinal edge and the second longitudinal edge.

3. An aerosol generating article according to claim 1 wherein the area of adhesive provided in the overlapping region is separated from the first longitudinal edge of the tipping wrapper by at least 1 mm along the full length of the area of adhesive.

4. An aerosol generating article according to claim 3 wherein the area of adhesive provided in the overlapping region of the removable tipping wrapper portion extends no more than 45 degrees circumferentially around the aerosol generating article.

5. An aerosol generating article according to claim 1 wherein the area of adhesive provided in the overlapping region of the removable tipping wrapper portion is separated from the downstream edge of the tipping wrapper by at least 1 mm.

6. An aerosol generating article according to claim 1 wherein the area of adhesive provided in the overlapping region of the removable tipping wrapper portion is separated from the first weakening line by at least 0.5 mm.

7. An aerosol generating article according to claim 1 wherein the first longitudinal edge comprises a tipping wrapper projection defining a tear tab downstream of the first weakening line and wherein the tear tab is free from adhesive.

8. An aerosol generating article according to claim 7 wherein the second longitudinal edge comprises an indent corresponding in shape and position to the tipping wrapper projection on the first longitudinal edge.

9. An aerosol generating article according to claim 1 wherein the removable tipping wrapper portion is secured to the underlying mouthpiece by of a second area of adhesive provided proximate the second longitudinal edge.

10. An aerosol generating article according to claim 9 wherein the second area of adhesive securing the removable tipping wrapper portion to the underlying mouthpiece is separated from the second longitudinal edge by a distance of between 0.5 mm and 1 mm.

11. An aerosol generating article according to claim 9 wherein the second area of adhesive securing the removable tipping wrapper portion to the underlying mouthpiece has a total surface area of between 4 square millimetres and 6 square millimetres.

12. An aerosol generating article according to claim 1 wherein the removable tipping wrapper portion extends to the downstream edge of the tipping wrapper.

13. An aerosol generating article according to claim 1, wherein the or each weakening line comprises a row of perforations extending around the tipping wrapper, wherein the row of perforations has a percentage of hold of between 15 percent and 30 percent.

14. An aerosol generating article according to claim 1 wherein the mouthpiece is circumscribed by a mouthpiece wrapper comprising one or more plug wraps, the one or more plug wraps having a basis weight of between 50 grams per square metre and 115 grams per square metre.

15. An aerosol generating article according to claim 14 wherein the one or more plug wraps extend beyond the downstream end of the mouthpiece to define a mouth end recess.

* * * * *